United States Patent [19]

Tafelski, Jr.

[11] 4,237,783

[45] Dec. 9, 1980

[54] STORAGE AND BANDING CONTAINER

[76] Inventor: Roman J. Tafelski, Jr., 1163 Colonial, Inkster, Mich. 48141

[21] Appl. No.: 11,313

[22] Filed: Feb. 12, 1979

[51] Int. Cl.[3] ..... B30B 7/00; B65B 13/18

[52] U.S. Cl. ..... 100/34; 100/245; 100/295

[58] Field of Search ..... 100/2, 3, 34, 100, 240, 100/245, 8, 295, 226, 237, DIG. 15

[56] References Cited

U.S. PATENT DOCUMENTS

| | | | |
|---|---|---|---|
| 2,364,518 | 12/1944 | Clouser | 100/34 |
| 3,228,166 | 1/1966 | Thiele | 100/3 X |
| 3,242,851 | 3/1966 | Brawley | 100/100 X |
| 3,498,214 | 3/1970 | Bailey | 100/34 |
| 3,593,654 | 7/1971 | Mayfield | 100/3 |
| 3,641,929 | 2/1972 | Ballard | 100/295 X |
| 3,691,945 | 9/1972 | Guhl | 100/DIG. 15 |

*Primary Examiner*—Billy J. Wilhite

*Attorney, Agent, or Firm*—Gifford, Van Ophem, Sheridan & Sprinkle

[57] ABSTRACT

A storage and banding container is provided having four side walls, a bottom wall, and an open top. Each of a pair of opposing side walls have a pair of vertically elongated slots dimensioned and adapted to receive the tines of a forklift vehicle. Scrap material, such as scrap banding, is accumulated in the container and can then be compressed by the tines of the forklift vehicle and banded together to form a compact bundle of scrap material. Load supports are secured to the bottom wall in order to support the scrap material above the surface of the bottom wall so that banding can be easily slid under and wrapped around the compressed bundle of scrap material. In addition, a portion of a pair of opposing side walls extend below the bottom wall so that the bottom wall is supported above the ground surface to enable the tines of a forklift vehicle to be inserted under the container for transport of the container.

6 Claims, 3 Drawing Figures

STORAGE AND BANDING CONTAINER

BACKGROUND OF THE INVENTION

I. Field of the Invention

The present invention relates to storage containers for scrap materials and in particular to such a container which enables the contents to be compressed by the tines of a forklift vehicle and which permits the scrap materials to be banded together to form a compact bundle.

II. Description of the Prior Art

Storage and disposal of scrap materials is a necessary but often costly and time consuming practice incident to many industrial and manufacturing operations. This is especially true in operations involving the delivery or receipt of parts of materials banded together so that they can be shipped in bulk. For example, when several pieces of pipe are to be shipped, they are banded together in a single bundle by several strips of metal banding. The metal band is wrapped around the pipe, tightened and then crimp locked in a manner well known. Subsequently, several such bundles are loaded onto a truck bed or other transfer platform and are again banded in a similar manner so that they are bound tightly to the truck bed or transfer platform.

Once the transport vehicle has reached its destination, the bands are cut and removed from the pipe. The scrap banding is then discarded, usually by throwing it into a large bin so that it does not clutter or interfere with business operations at the work area. The scrap banding accumulates in the bin and when the bin becomes filled, it is emptied into a truck or alternatively loaded onto a truck so that it can be shipped away and sold for salvage.

However, each loaded bin or truck contains much wasted space due to the resiliency of the banding. Since the salvage price for the scrap banding is determined by the net weight of each load of scrap delivered, it is advantageous to deliver the maximum possible weight of scrap that can fit into the container or in the truck in which the scrap is delivered for salvage. Unless the banding can be compressed so that the maximum weight per volume can be shipped with each load, many extra trips between the work area and the salvage yard are necessary to salvage the scrap even though the weight of scrap remains the same.

Consequently, the previously-known salvage of scrap bands has been heretofore extremely costly and time consuming. Moreover, since such scrap removal and salvage is merely incident to the industrial or commercial operations of the businesses using such banding, it is economically advantageous to keep the expense of such operations at a minimum.

There are several previously-known bundling and storage containers such as those disclosed in U.S. Pat. Nos. 3,459,120, 3,826,186, and 2,575,048. These devices, however, are generally directed for use in bundling newspapers and are not readily adaptable for use in large commercial industrial operations. Moreover, they are not appropriate for use in storing and discarding scrap banding. Another disadvantage of these previously-known storage and bundling containers is that they are rather complicated structures and therefore, even if they could be adapted for use in large scale scrap discard operations, they would be extremely costly and difficult to operate.

SUMMARY OF THE PRESENT INVENTION

The present invention overcomes the above-mentioned disadvantages of salvaging scrap bands by providing a storage and banding container which is adapted for use with a forklift vehicle to permit the compacting and banding of scrap materials, and particularly scrap bands, to form compact and relatively small bundles.

In brief, the container of the present invention comprises a housing having four side walls, a bottom wall, and an open top. At least one pair of opposing side walls are provided with vertically elongated slots open at their top and dimensioned to receive the tines of the forklift vehicle and to permit vertical displacement of the tines with respect to the housing. Thus, when the container has been filled with scrap banding, a forklift vehicle can be driven up to the container and the tines of the fork lowered through the open top of the elongated slots and, upon downward travel of the tines, the tines compress the scrap banding contained within the housing.

Preferably, a load support means is secured to the bottom wall of the container so that the compressed material is supported above the surface of the bottom wall. Moreover, the elongated slots are wide enough so that with the tines inserted in the slots, sufficient space is available to permit new banding to be wrapped around the compressed material to form a bundle within the container. The material is tightly wrapped by sliding the new banding through the space between the bottom of the compressed material and the surface of the bottom wall, around the compressed material, and then locking the new banding in place in the conventional manner. In addition, the container is preferably provided with means for supporting the bottom wall of the container above the ground surface so that the fork of a forklift vehicle can easily be inserted under the bottom wall of the container and so that the container can be lifted and transported from work area to work area by the forklift truck.

BRIEF DESCRIPTION OF THE DRAWINGS

The present invention will be more clearly understood by reference to the following detailed description when read in conjunction with the accompanying drawing in which like reference characters refer to like parts throughout the several views and in which.

DETAILED DESCRIPTION OF THE PRESENT INVENTION

Figure 1:
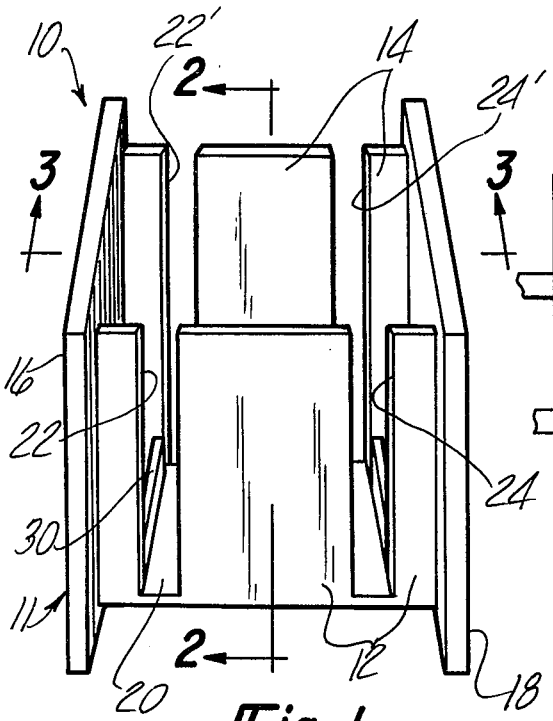
FIG. 1 is a perspective view of a scrap banding container of the present invention.

Referring now to FIG. 1, the scrap banding container 10 of the present invention is thereshown comprising an opentopped housing 11 having a front wall 12, a back wall 14, side walls 16 and 18 and floor 20. The front wall 12 is provided with a pair of vertically elongated slots 22 and 24 extending from the top edgeof the wall 12 to the top surface of the floor 20. The slots 20 and 24 register with a like pair of vertically elongated slots 22' and 24' in the back wall 14. Load supports 30 are secured to the top surface of the floor 20 and are located outside the zone of the registering slots 22, 22' and 24, 24'. In addition, as best shown in FIG. 3 side wall 16 and 18 extend below the floor 20 so that the floor 20 is spaced above the ground surface.

Figure 2:
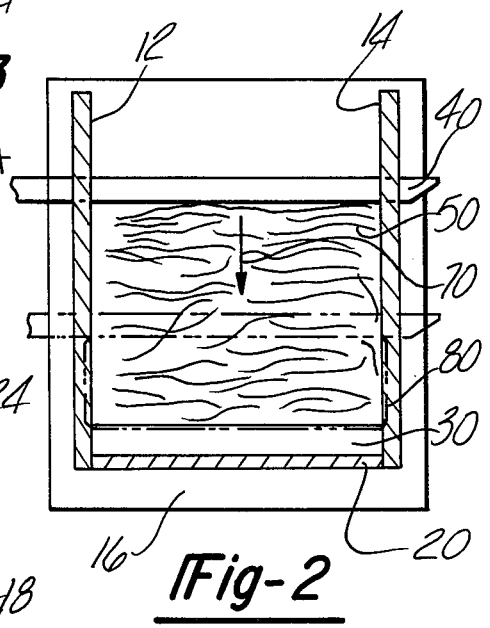
FIG. 2 is a cross-sectional elevation of the scrap banding container of the present invention taken substantially along the line 2—2 in FIG. 1.

Referring now to FIG. 2, the distance between the front wall 12 and the back wall 14 is dimensioned to permit the tines 40 (FIG. 3) of a forklift vehicle 80 to extend completely through the registering slots 22, 22' and 24, 24'. Thus, the motive force exerted by the tines 40 as they descend upon the scrap banding 50 within the container 10 is evenly distributed across a complete cross section of the container contents. In addition, the load supports preferably extend from the front wall 12 to the back wall 14 so that the resistive compressive forces exerted upon the scrap banding 50 are exerted across an entire cross section of the contents of the container. Moreover, to insure that the motive and resistive compressive forces exerted on the scrap banding 50 are evenly distributed across substantially the same cross section of the contents of the container, the load supports 30 are secured directly adjacent to the sides of the slots 22, 22' and 24, 24' as is best shown in FIG. 3.

Figure 3:
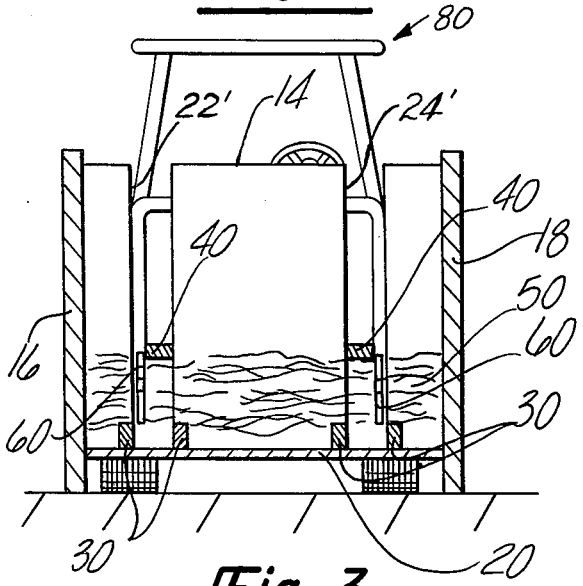
FIG. 3 is a cross-sectional elevation of the scrap banding container of the present invention taken substantially along the line 3—3 in FIG. 1.

Referring now to FIG. 3, the distance between the side walls 16 and 18 can be seen to be mainly dependent upon the spacing of the slots 22, 22' and 24, 24' which in turn, is dependent upon the separation between the tines 40 of the forklift vehicle. Since the spacing between these tines is often adjustable, these distances are typically dependent upon the size of the bundle desired to be formed as dictated by volume and weight requirements of the salvager. Although the distance between the slots 22, 22' and 24, 24' is selectively variable, the width of each of the slots 22, 22', 24, and 24' is determined by the width of each of the tines 40. Moreover, it is preferable that these slots have a width slightly greater than the width of the tines 40 so that when the bundle is compressed, new banding can be wrapped around the compressed scrap banding 50 adjacent to the tines 40 to thus tightly bind the scrap banding 50 to form a bundle. Since the compressed scrap banding 50 is supported above the floor 20 by the load supports 30, the new banding can be easily inserted under and wrapped entirely around the compressed contents of the container to form the bundle. Moreover, the load supports 30 permit the tines 40 of the forklift vehicle to be inserted under the banded bundle to lift and remove it from the container.

In addition, the side walls 16 and 18 are preferably spaced relatively close to the slots 22, 22' and 24, 24' respectively so that although the new banding 60 is spaced away from the ends of the bundle, the ends of the bundle remain relatively tightly bound. Nevertheless, the ends of the bundle extend a sufficient amount past the lateral edge of the tines 40 so as to counteract any bending of the bundle between the tines which would permit it to fall between the tines.

In operation, since the floor 20 is supported above the ground surface by the extended sides 16 and 18, the tines 40 can be easily inserted under the floor 20 in order to lift the container above the ground surface for transportation to a work area. Once the container has been positioned in the work area, a scrap banding 50 can be easily thrown into the open top of the container 10 by the workman who cuts and removes the banding from railroad cars, bundles or the like.

After the container becomes full of the uncompacted scrap banding 50, the forklift vehicle is driven toward the front wall 12 of the container to place the tines 40 in registration with the top of the slots 22, 22' and 24, 24'. The tines are then driven downward in the direction of the arrow 70 shown in FIG. 2 to compress the relatively loose scrap banding 50 into a relatively tight bundle 80 as indicated in phantom line in FIG. 2. While the tines 40 remain on top of the compressed bundle 80, a new banding 60 can be inserted between the floor 20 and the bottom of the compressed bundle 80 between the load supports 30 and adjacent to the tine 40 so that the bundle 80 can be bound and secured in the conventional fashion. Once the bundle 80 has been tightly secured by the new banding 60, the tines 40 are lifted and removed from the top of the bundle and removed from the container. The tines 40 are then reinserted into the container beneath the bundle 80 in the slots 22, 22' and 24, 24' between the load supports 30 so that the bundle can be lifted out of the storage container and transported to a transport vehicle or scrap storage area.

Thus, the present invention provides an apparatus for forming compacted scrap bundles which increases the salvage value of the scrap banding. Moreover, it is to be understood that although the operation of the storage container of the present invention has been described with respect to scrap banding, the present invention is not so limited and is applicable for use in bundling various other materials which need to be compacted and bound together to form bundles.

Having thus described my invention, many modifications thereto will become apparent to those skilled in the art to which it pertains without departing from the scope and spirit of the present invention in the appended claims:

I claim:

1. In combination, a forklift vehicle including means for forcibly displacing the tines of the forklift vehicle downwardly and a container having four side walls, a bottom wall and an open top wherein each wall of at least one pair of opposed side walls includes a pair of vertically elongated slots adapted to receive the tines of said forklift vehicle and permit vertical displacement of the tines relative to said housing, wherein said bottom wall of said container resists the force exerted by said tines displacing means upon the contents of the container.

2. The invention as defined in claim 1 and further comprising means for supporting a load of scrap banding above the surface of said bottom wall and against the force exerted upon the load of scrap banding during compacting of the scrap banding by the forklift tines.

3. The invention as defined in claim 2 wherein said means for supporting a load above the surface of said bottom wall comprises a beam secured to the bottom wall adjacent each side of each elongated slot and extending between opposing side walls.

4. The invention as defined in claim 1 and further comprising means for supporting said bottom wall above the ground surface.

5. The invention as defined in claim 4 wherein said means for supporting said bottom wall above a ground surface comprises a portion of each of a pair of opposing side walls.

6. The invention as defined in claim 1 wherein said each elongated slot has a width dimensioned to receive a strap of banding adjacent said tine to permit the strap to be wrapped and tightened around the contents of the container while the contents are compressed by the tines of the forklift vehicle.

* * * * *

UNITED STATES PATENT AND TRADEMARK OFFICE

CERTIFICATE OF CORRECTION

PATENT NO. : 4,237,783

DATED : December 9, 1980

INVENTOR(S) : Roman J. Tafelski, Jr.

It is certified that error appears in the above-identified patent and that said Letters Patent are hereby corrected as shown below:

Column 2, line 65, delete "edgeof" and insert --edge of-- therefor.

Signed and Sealed this

*Tenth* Day of *March 1981*

[SEAL]

*Attest:*

RENE D. TEGTMEYER

*Attesting Officer*

*Acting Commissioner of Patents and Trademarks*